US010854967B2

(12) United States Patent
Zimmerman

(10) Patent No.: US 10,854,967 B2
(45) Date of Patent: Dec. 1, 2020

(54) BASE STATION ANTENNAS THAT ARE CONFIGURABLE FOR EITHER INDEPENDENT OR COMMON DOWN TILT CONTROL AND RELATED METHODS

(71) Applicant: CommScope Technologies LLC, Hickory, NC (US)

(72) Inventor: Martin L. Zimmerman, Chicago, IL (US)

(73) Assignee: CommScope Technologies LLC, Hickory, NC (US)

( * ) Notice: Subject to any disclaimer, the term of this patent is extended or adjusted under 35 U.S.C. 154(b) by 139 days.

(21) Appl. No.: 15/936,575

(22) Filed: Mar. 27, 2018

(65) Prior Publication Data

US 2018/0287255 A1 Oct. 4, 2018

Related U.S. Application Data

(60) Provisional application No. 62/478,632, filed on Mar. 30, 2017.

(51) Int. Cl.

| | |
|---|---|
| ***H01Q 3/32*** | (2006.01) |
| ***H01Q 3/08*** | (2006.01) |
| ***H01Q 1/24*** | (2006.01) |
| ***H01Q 3/06*** | (2006.01) |
| *H01Q 3/36* | (2006.01) |

(Continued)

(52) U.S. Cl.

CPC ..... *H01Q 3/32* (2013.01); *H01Q 1/246* (2013.01); *H01Q 3/06* (2013.01); *H01Q 3/08* (2013.01); *H01Q 3/36* (2013.01); *H01Q 21/26* (2013.01); *H01Q 21/28* (2013.01)

(58) Field of Classification Search

CPC ..... H01Q 3/32; H01Q 1/246

See application file for complete search history.

(56) References Cited

U.S. PATENT DOCUMENTS 6,667,714 B1 * 12/2003 Solondz ..... H01Q 1/246 342/368

2002/0126059 A1 9/2002 Zimmerman et al.

(Continued)

FOREIGN PATENT DOCUMENTS

| | | |
|---|---|---|
| CN | 103311669 | 9/2013 |
| CN | 104067443 | 9/2014 |

(Continued)

OTHER PUBLICATIONS

Notification of Transmittal of the International Search Report and the Written Opinion of the International Searching Authority, or the Declaration, for International Application No. PCT/US2018/024726, dated Jun. 28, 2018, 18 pgs.

(Continued)

*Primary Examiner* — Daniel Munoz

(74) *Attorney, Agent, or Firm* — Myers Bigel, P.A.

(57) ABSTRACT

Methods of operating a base station antennas involve receiving a first control signal at the base station antenna, activating a first actuator to move a first mechanical linkage in response to the first control signal and activating a second actuator to move a second mechanical linkage in response to the first control signal. Pursuant to these methods, base station antenna can be configured for both independent or common control of the first and second actuators.

18 Claims, 7 Drawing Sheets

(51) Int. Cl.
*H01Q 21/26* (2006.01)
*H01Q 21/28* (2006.01)

(56) References Cited

U.S. PATENT DOCUMENTS

| | | | | |
|---|---|---|---|---|
| 2006/0244675 | A1* | 11/2006 | Elliot | H01P 1/18 343/853 |
| 2009/0075701 | A1 | 3/2009 | Haskell et al. | |
| 2010/0201591 | A1* | 8/2010 | Girard | H01Q 1/246 343/766 |
| 2013/0214973 | A1 | 8/2013 | Veihl et al. | |
| 2015/0244069 | A1 | 8/2015 | Moon et al. | |
| 2017/0365923 | A1 | 12/2017 | Schmutzler et al. | |

FOREIGN PATENT DOCUMENTS

| | | |
|---|---|---|
| CN | 104090531 | 10/2014 |
| CN | 104641509 | 5/2015 |

OTHER PUBLICATIONS

English translation of the First Office Action corresponding to Chinese Patent Application No. 201880021801.2 (21 pages) (dated Jul. 15, 2020).

* cited by examiner

BASE STATION ANTENNAS THAT ARE CONFIGURABLE FOR EITHER INDEPENDENT OR COMMON DOWN TILT CONTROL AND RELATED METHODS

CROSS-REFERENCE TO RELATED APPLICATION

The present application claims priority under 35 U.S.C. § 119 to U.S. Provisional Patent Application Ser. No. 62/478,632, filed Mar. 30, 2017, the entire content of which is incorporated herein by reference as if set forth in its entirety.

FIELD OF THE INVENTION

The present invention relates to communication systems and, in particular, to base station antennas having remote electrical down tilt capabilities and to methods of operating such antennas.

BACKGROUND

Base station antennas for wireless communication systems are used to transmit radio frequency ("RF") signals to, and receive RF signals from, fixed and mobile users of a cellular communications service. Base station antennas are directional devices that can concentrate the RF energy that is transmitted in, and received from, certain directions. The "gain" of a base station antenna in a given direction is a measure of the ability of the antenna to concentrate the RF energy in that particular direction. The "radiation pattern" of a base station antenna is compilation of the gain of the antenna across all different directions. The radiation pattern of a base station antenna is typically designed to service a pre-defined coverage area, which refers to a geographic region in which fixed and mobile users can communicate with the cellular network through the base station antenna. The base station antenna may be designed to have gain levels that meet or exceed pre-defined thresholds throughout this pre-defined coverage area. It is typically desirable that the base station antenna also have much lower gain levels outside of the coverage area to reduce interference.

Early base station antennas typically had a fixed radiation pattern, meaning that once a base station antenna was installed, its radiation pattern could not be changed unless a technician physically reconfigured the antenna. Unfortunately, such manual reconfiguration of base station antennas after deployment, which could become necessary due to, for example, changes in typical user locations within the coverage area, changed environmental conditions and/or the installation of additional base stations, was typically difficult, expensive and time-consuming.

More recently, base station antennas have been deployed that have radiation patterns that can be reconfigured from a remote location. For example, base station antennas have been developed for which settings such as the down tilt angle, beam width and/or azimuth angle of the antenna can be reconfigured from a remote location by transmitting control signals to the antenna. Base station antennas that can have their down tilt or "elevation" angle changed from a remote location are typically referred to as remote electrical tilt ("RET") antennas. RET antennas allow wireless network operators to remotely adjust the radiation pattern of the antenna through the use of electro-mechanical actuators that may adjust phase shifters or other devices in the antenna to affect the radiation pattern of the antenna. Typically, the radiation pattern of a RET antenna is adjusted using actuators that are controlled via control signal specifications promulgated by the Antenna Interface Standards Group ("AISG").

Base station antennas typically comprise a linear array or a two-dimensional array of radiating elements such as dipole or crossed dipole radiating elements. In order to change the down tilt angle of these antennas, a phase taper may be applied across the radiating elements, as is well understood by those of skill in the art. Such a phase taper may be applied by adjusting the settings on an adjustable phase shifter that is positioned along the RF transmission path between a radio and the individual radiating elements of the base station antenna. One known type of phase shifter is an electromechanical rotating "wiper" arc phase shifter that includes a main printed circuit board and a "wiper" printed circuit board that may be rotated above the main printed circuit board. Such rotating wiper arc phase shifters typically divide an input RF signal that is received at the main printed circuit board into a plurality of sub-components, and then capacitively couple at least some of these sub-components to the wiper printed circuit board. These sub-components of the RF signal may be capacitively coupled from the wiper printed circuit board back to the main printed circuit board along a plurality of arc-shaped traces, where each arc has a different radius. Each end of each arc-shaped trace may be connected to a radiating element or to a sub-group of radiating elements. By physically rotating the wiper printed circuit board above the main printed circuit board, the location where the sub-components of the RF signal capacitively couple back to the main printed circuit board may be changed, thereby changing the path lengths that the sub-components of the RF signal traverse when passing from a radio to the radiating elements. These changes in the path lengths result in changes in the phases of the respective sub-components of the RF signal, and since the arcs have different radii, the change in phase experienced along each path differs. Typically, the phase taper is applied by applying positive phase shifts of various magnitudes (e.g., +1°, +2° and +3°) to some of the sub-components of the RF signal and by applying negative phase shifts of the same magnitudes (e.g., −1°, −2° and −3°) to additional of the sub-components of the RF signal. Thus, the above-described rotary wiper arc phase shifters may be used to apply a phase taper to the sub-components of an RF signal that are transmitted through the respective radiating elements (or sub-groups of radiating elements). Exemplary phase shifters of this variety are discussed in U.S. Pat. No. 7,907,096 to Timofeev, the disclosure of which is hereby incorporated herein by reference in its entirety. The wiper printed circuit board is typically moved using an actuator that includes a direct current ("DC") motor that is connected to the wiper printed circuit board via a mechanical linkage. These actuators are often referred to as RET actuators since they are used to apply the remote electrical down tilt.

SUMMARY

Pursuant to embodiments of the present invention, methods of operating a base station antenna are provided in which a first control signal is received at the base station antenna. A first actuator is activated to move a first mechanical linkage in response to the first control signal. A second actuator is also activated to move a second mechanical linkage in response to the first control signal.

In some embodiments, the first and second actuators are activated at different times. For example, the second actuator may be activated immediately after the first actuator.

In some embodiments, the first actuator is moved the same amount as the second actuator.

In some embodiments, the first actuator drives the first mechanical linkage to adjust a first phase shifter in order to apply an electrical down tilt of a first number of degrees to a first array of radiating elements of the base station antenna, and the second actuator drives the second mechanical linkage to adjust a second phase shifter in order to apply an electrical down tilt of the first number of degrees to a second array of radiating elements of the base station antenna.

In some embodiments, the base station antenna includes a remote electrical down tilt (RET) controller that includes firmware that is configured to receive the first control signal and in response thereto generate sequential first and second internal control signals that are used to activate the respective first and second actuators. In such embodiments, the first actuator and the second actuator may, for example, be part of a multi-RET actuator assembly that includes a plurality of RET actuators.

In some embodiments, the first control signal is an AISG control signal.

In some embodiments, the base station antenna includes a selection mechanism that selectively configures the base station antenna to either independently control or commonly control down tilts on first and second arrays of radiating elements.

In some embodiments, the base station antenna includes first and second arrays of radiating elements that are configured for multi-input-multi-output transmission, wherein the first array of radiating elements is fed by a first phase shifter that is attached to the first mechanical linkage, and the second array of radiating elements is fed by a second phase shifter that is attached to the second mechanical linkage.

Pursuant to further embodiments of the present invention base station antennas are provided that include a first vertical array of radiating elements, a first phase shifter that is included in a first feed network that connects the first vertical array to a first radio port, a first remote electrical down tilt (RET) actuator, a first mechanical linkage that extends between the first RET actuator and the first phase shifter, a second vertical array of radiating elements, a second phase shifter that is included in a second feed network that connects the second vertical array to a second radio port, a second RET actuator, a second mechanical linkage that extends between the second RET actuator and the second phase shifter, and a RET controller that is configured to control the first RET actuator to move in response to an external control signal to adjust the first phase shifter and to control the second RET actuator to move to adjust the second phase shifter by the same amount as the first phase shifter.

In some embodiments, the RET controller is configured to control the first RET actuator to move in response to the external command to adjust the first phase shifter and after the adjustment to the first phase shifter is completed to then control the second RET actuator to adjust the second phase shifter.

In some embodiments, the first and second vertical arrays are configured for multi-input-multi-output transmission.

Pursuant to still further embodiments of the present invention, base station antennas are provided that include a first remote electrical down tilt (RET) actuator, a second RET actuator, a RET controller, and a switch that in a first position configures the RET controller to control the first and second RET actuators independently and that in a second position configures the RET controller to commonly control the first and second RET actuators.

In some embodiments, the RET controller is configured to activate the first RET actuator and the second RET actuator sequentially when the switch is in the second position.

In some embodiments, the RET controller is configured to move the first and second RET actuators by the same amounts when the switch is in the second position.

In some embodiments, the first RET actuator is coupled to a first phase shifter by a first mechanical linkage and the second RET actuator is coupled to a second phase shifter by a second mechanical linkage that does not share any common components with the first mechanical linkage.

DETAILED DESCRIPTION

Figure 1A:
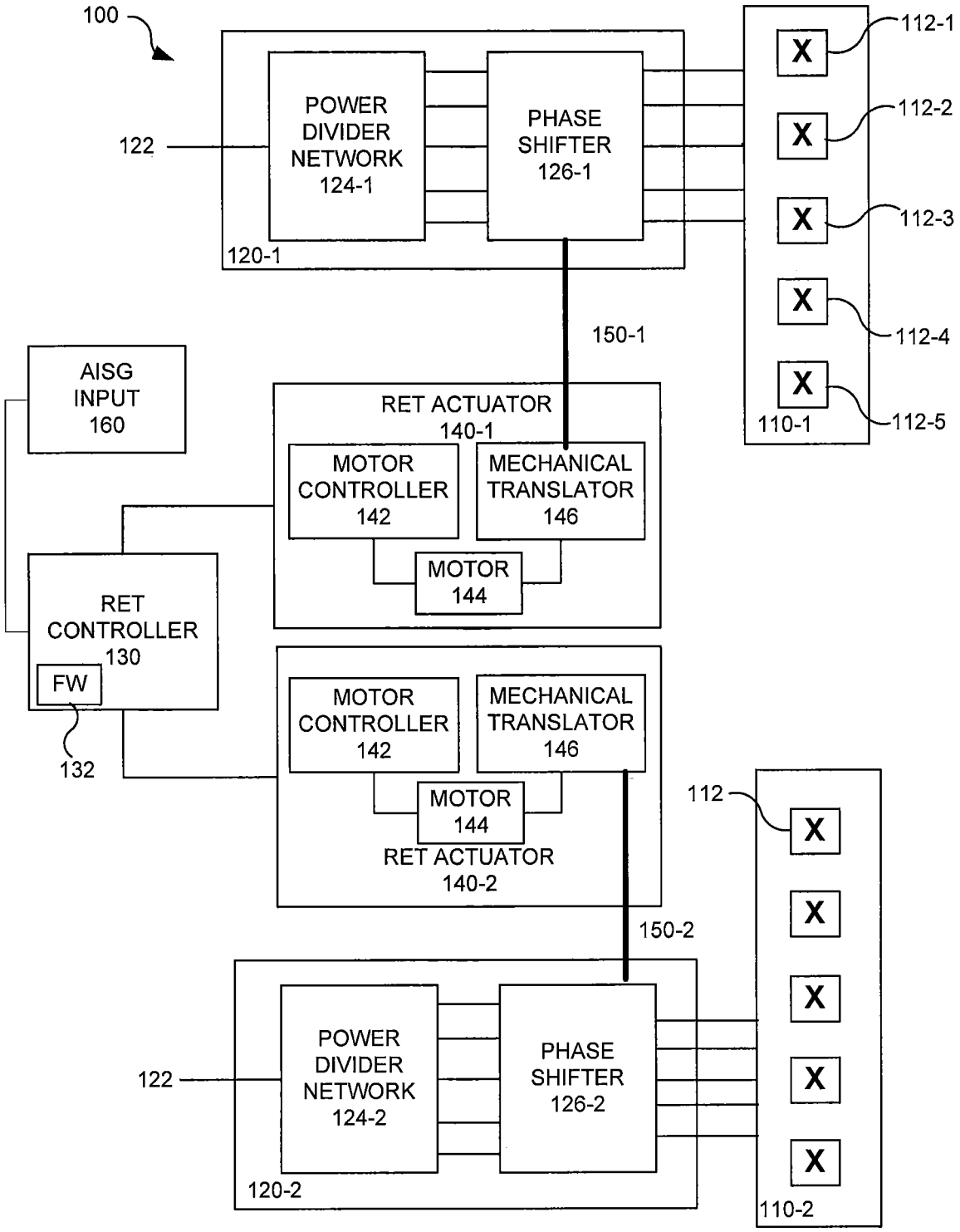
FIG. 1A is a schematic diagram of a base station antenna which provides independent control of the down tilt for each vertical array of the antenna.

Pursuant to embodiments of the present invention, base station antennas are provided that have controllers that are designed to sequentially adjust the down tilt on two different vertical arrays of the antenna by actuating two or more different RET actuators in response to a single control signal. This approach allows a common base station antenna design to be used for both (1) customers that want independent control of each RET actuator and (2) customers that want to control two or more RET actuators using a single control signal. This approach may eliminate the need to design and manufacture multiple versions of an antenna to accommodate customers who desire different granularity of control over the RET actuators. Moreover, the capability to actuate multiple RET actuators in response to a single control signal may be implemented, for example, solely in firmware such that the only difference between two antennas having different capabilities may be a RET configuration data file that is, for example, uploaded to the RET controller on the antenna during production or later as an AISG software message and/or as a simulated AISG firmware update, or by any other appropriate means.

Example embodiments of the present invention will now be described in greater detail with reference to the attached figures.

Base station antennas are being deployed that have multiple vertically-oriented linear arrays of radiating elements (herein "vertical arrays"). The multiple vertical arrays may be provided, for example, to support multiple different frequency bands, to support multi-input-multi-output ("MIMO") operations, and/or to allow formation of narrow antenna beams. In many cases, wireless operators may want the capability to apply independent remote electrical down tilts to each vertical array. However, in some applications, such as base station antennas that use two or more vertical arrays to transmit signals using MIMO transmission techniques, certain wireless operators may want the same electrical down tilt applied to each vertical array, and may want to use a single control signal to effect this common electrical down tilt on both vertical arrays. In such situations, the base station antenna is designed so that a single remote electrical down tilt command (e.g., delivered as an AISG command) may be used to apply the same electrical down tilt to two (or more) vertical arrays. Herein, a base station antenna in which the down tilts on at least two vertical arrays are controlled by a single control signal are referred to as having "commonly controlled" down tilt, whereas a base station antenna in which the down tilt on each vertical array is controlled by an independent control signal is referred to as having "independently controlled" down tilt.

Currently, if wireless operators want a first version of a particular model of a base station antenna that has independently controlled electrical down tilt and another version of the antenna that has commonly controlled down tilt, then two different base station antennas are designed that have different physical layouts and different quantities of mechanical linkages and RET actuators. This adds time and expense to the engineering design and development process. In addition, since the two different antenna designs have different internal parts, the overall number of parts required to build both antennas is increased. Each version of the base station antenna likewise requires separate build instructions, and it is also more expensive to upgrade, reconfigure and/or redesign the base station antenna later if there are two separate versions of the antenna that have independently controlled and commonly controlled down tilt.

Pursuant to embodiments of the present invention, a single base station antenna may be provided that may be used in applications requiring both independently controlled and commonly controlled electrical down tilt. In some embodiments, a switch or other setting may be set to cause the base station antenna to (1) operate in either an independently controlled down tilt mode of operation or (2) operate in a commonly controlled down tilt mode of operation. In other embodiments, firmware may be loaded into the antenna during the production process that determines the mode in which the antenna operates (i.e., independently controlled or commonly controlled down tilt). By providing a base station antenna that may operate in either mode it is possible to simplify the engineering design and development process for the antenna and obtain various other benefits, such as reduced part counts and common build instructions. As discussed herein, these advantages can be obtained with little or no offsetting disadvantages.

Figure 1B:
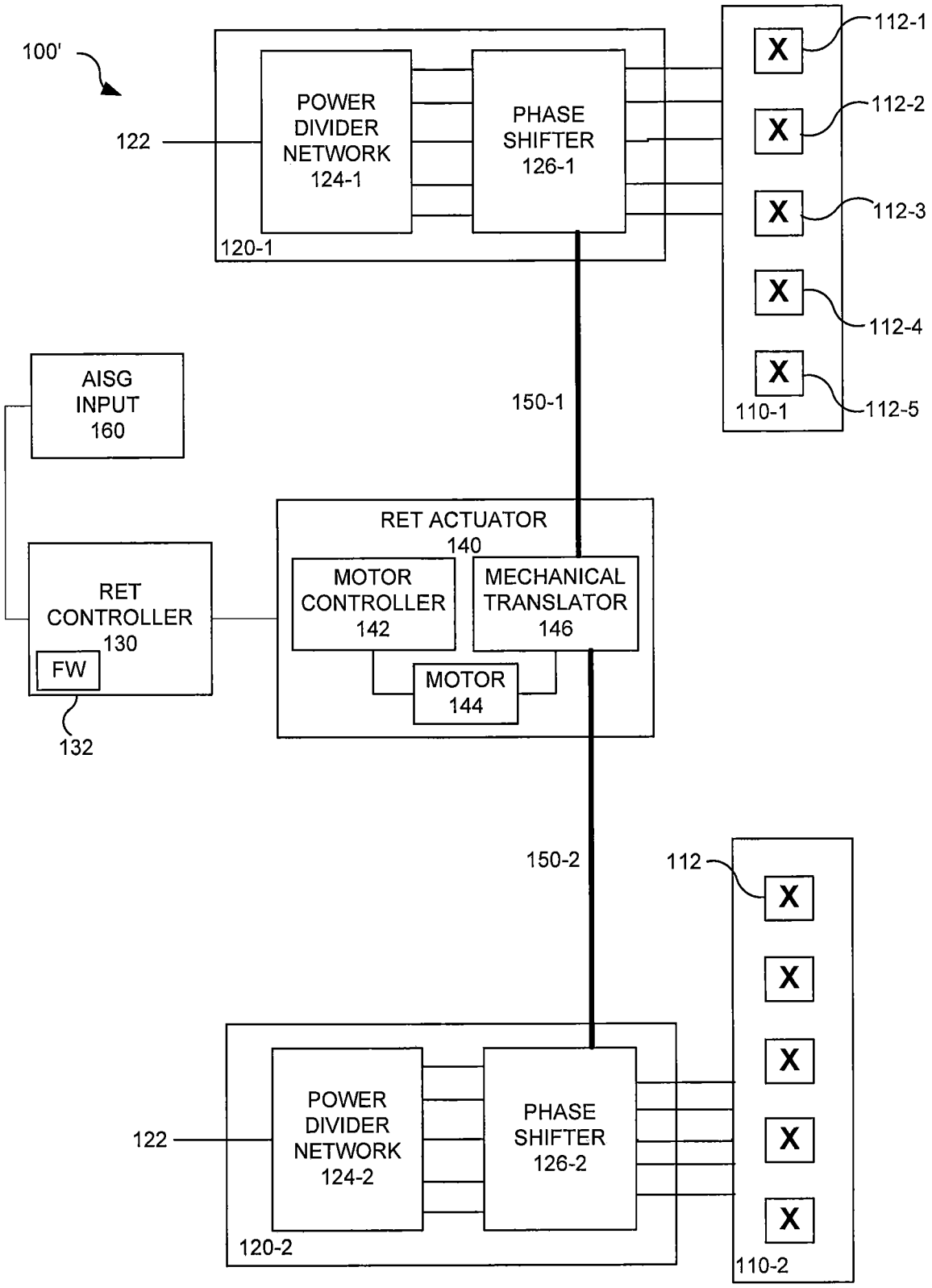
FIG. 1B is a schematic diagram of a base station antenna which commonly controls the down tilt for at least two vertical arrays of the antenna.

FIGS. 1A and 1B are schematic block diagrams illustrating the conventional solution employed when wireless operators require a first version of a base station antenna that has independently controlled down tilt and a second version of that base station antenna that has commonly controlled down tilt. It should be noted that FIGS. 1A and 1B do not show the actual location of the various elements on the antenna, but instead simply show the connections between the various elements. It will also be appreciated that the connection lines in FIGS. 1A and 1B represent paths for electrical signals (e.g., RF transmission lines). The same approach is taken in the other schematic diagrams included in this application.

FIG. 1A is a schematic diagram of a base station antenna 100 which is designed to provide independently controlled down tilt. As shown in FIG. 1A, the base station antenna 100 includes first and second vertical arrays 110-1, 110-2 of radiating elements 112. Each vertical array 110 (note that herein elements having two-part reference numerals such as the vertical arrays 110-1, 110-2 may be referred to collectively by the first part of their reference numeral or individually by their full reference numerals) may be fed by a respective feed network 120-1, 120-2. Each feed network 120 includes an input 122 and a power divider network 124 that divides an RF signal that is received at the input 122 into a plurality of sub-components. The input 122 of each feed network 120 may be connected to a radio (not shown) such as a remote radio head.

Some or all of the sub-components of the RF signal may be phase shifted by a phase shifter 126 that is included in the feed network 120. Each phase shifter 126 applies a phase taper to the sub-components as they are fed to the individual radiating elements 112 in the vertical arrays 110. Such phase tapers may be used to apply an electrical down tilt to the radiation pattern formed by each vertical array 110. As an example, the first radiating element 112-1 in linear array 110-1 may have a phase of Y°+2X°, the second radiating element 112-2 may have a phase of Y°+X°, the third radiating element 112-3 may have a phase of Y°, the fourth radiating element 112-4 may have a phase of Y°−X°, and the fifth radiating element 112-5 may have a phase of Y°−2X°.

In many instances, both the power divider network 124 and the phase shifter 126 for a vertical array 110 may be implemented as a single, electromechanical phase shifter such as a rotary wiper arc phase shifter. An example of such a phase shifter is described below with reference to FIG. 4. Only two vertical arrays 110 and associated feed networks 120 are shown in FIG. 1A to simplify the drawing. It will be appreciated, that more vertical arrays 110 and feed networks 120 may be provided. It will likewise be appreciated that if the radiating elements 112 are implemented as dual polarized radiating elements such as slant +/−45 degree dipole radiating elements, the number of feed networks 120 will be doubled since each polarization may be fed by a separate feed network 120.

Still referring to FIG. 1A, the base station antenna 100 further includes a RET controller 130, first and second RET actuators 140-1, 140-2 and first and second mechanical linkages 150-1, 150-2. The base station antenna 100 may further include a control signal input 160 such as a connector that receives external control signals over a control cable from a remote location. It will be appreciated that the control signal input 160 may comprise any appropriate control signal input including, for example, an AISG connector or a bias-T or other device that is used to inject and/or extract control signals from an RF cabling connection, and that the control cable may be, for example, a separate control cable or a cable that carries both RF signals and control communications. In the simple example of FIG. 1A, the external control signal may comprise, for example, an external control signal R1 that is used to adjust the down tilt of the first vertical array 110-1 or an external control signal R2 that is used to adjust the down tilt of the second vertical array 110-2. The control signal input 160 may be connected to the RET controller 130 by, for example, a cabling connection to allow external control signals to be transmitted to the RET controller 130 from the remote location. The RET controller 130 may include firmware 132 that controls the operation thereof. The RET controller 130 may receive external control signals (e.g., R1 or R2) and generate internal control signals in response thereto such as, for example, internal control signals M1 and M2 that will cause physical movement of the phase shifters 126 as will be described in detail below. The RET controller 130 may be implemented, for example using a commercially available microcontroller, application specific integrated circuit or the like.

The internal control signals may be transmitted from the RET controller 130 to the RET actuators 140. In FIG. 1A only two RET actuators 140-1, 140-2 are shown, namely one for each vertical array 110-1, 110-2. It will be appreciated that more RET actuators 140 may be provided in other embodiments. For example, if wideband radiating elements 112 are used that transmit and receive RF signals in multiple frequency bands, then diplexers (not shown) may be provided along the feed path between the phase shifter 126 and the radiating elements 112, and each frequency dependent output of each diplexer may be fed to a different phase shifter 126 so that independent phase shifts may be applied to each frequency band. Additional RET actuators 140 may be provided to adjust these additional phase shifters in such embodiments As shown in FIG. 1A, each RET actuator 140 may be implemented, for example, as a motor controller 142, a DC motor 144 and a mechanical translator 146 such as a worm gear with an internally threaded piston mounted thereon that translates the circular motion applied to the drive shaft of the DC motor 144 into linear motion. Each mechanical translator 146 may be coupled to a respective one of the mechanical linkages 150. The motor controller 142 may receive the internal control signal from the RET controller 130 and, in response thereto, may activate the motor 144. As the drive shaft on the motor 144 spins upon activation, the piston that is mounted on the worm gear moves linearly. The mechanical linkage 150 may be connected to the piston and hence the mechanical linkage 150 may move linearly in response to the rotation of the drive shaft of motor 144. Another portion (e.g., a far end) of the mechanical linkage 150 may be connected to a moving part (e.g., the wiper printed circuit board) of the electromechanical phase shifter 126 so that movement of the mechanical linkage 150 results in an adjustment of a setting of the phase shifter 126 so that the phase shifter 126 applies more or less phase shift. In this fashion, an external control signal received at the control input 160 may be used to change an electrical down tilt of one of the vertical arrays 110.

In the base station antenna 100 of FIG. 1A, a RET actuator 140 is provided for each vertical array 110. Thus, the electrical down tilt applied to each vertical array 110 may be independently controlled. In contrast, FIG. 1B is a block diagram of a base station antenna 100' in which the down tilts for the vertical arrays 110-1, 110-2 are commonly controlled. Like elements in FIG. 1B have been designated with the same reference numeral as in FIG. 1A and repeated descriptions of these elements will be omitted.

As can be seen, the base station antenna 100' is very similar to the base station antenna 100, but differs in that the base station antenna 100' includes a single RET actuator 140 that is used to drive both mechanical linkages 150-1, 150-2 (or, alternatively, a single mechanical linkage 150 that connects to both phase shifters 126). Thus, when an external control signal is received at base station antenna 100' calling for a change in the down tilt, the same change is simultaneously made to the down tilt on both vertical array 110-1 and vertical array 110-2 via the single RET actuator 140 and the mechanical linkage(s) 150.

In the base station antenna 100' of FIG. 1B, the external control signal may comprise, for example, an external control signal R1. In response to the external control signal R1, the RET controller 130 generates an internal control signal M1 that moves RET actuator 140. As the mechanical linkages 150-1, 150-2 are both connected to the mechanical translator 146 of RET actuator 140, the down tilt of the first vertical array 110-1 and the down tilt of the second vertical array 110-2 are simultaneously adjusted by the same amount. As noted above, in some cases, a single mechanical linkage 150 may be provided. In such embodiments, the first end of the mechanical translator 150 may be connected to the mechanical translator 146 of RET actuator 140, and the other end may be connected to the wiper arms on both phase shifters 126. The phase shifters 126 may be mounted back-to-back to facilitate such a connection.

Figure 2:
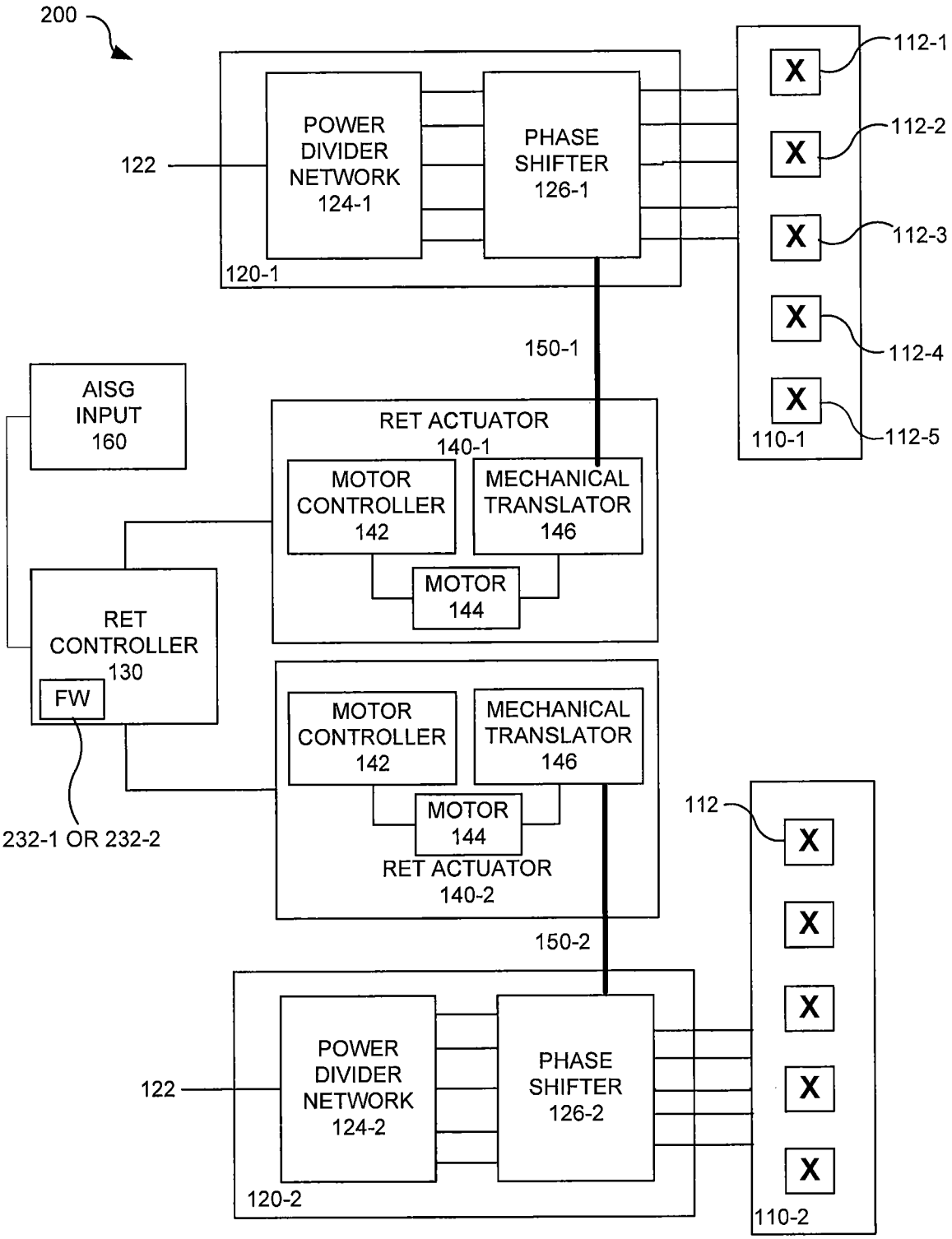
FIG. 2 is a schematic diagram of a base station antenna according to embodiments of the present invention that may provide independent or common control of the down tilt applied to the vertical arrays of the antenna.

FIG. 2 is a schematic diagram of a base station antenna 200 according to embodiments of the present invention that may provide independent or common control of the down tilt on multiple vertical arrays.

The base station antenna 200 may be similar to the base station antenna 100 described above. Accordingly, elements of base station antenna 200 that have already been described above are labelled with the same reference numerals and will not be described further herein. Base station antenna 200 differs from base station antenna 100 in that the firmware in the RET controller 130 is configured in one of two configurations. In the first configuration, firmware 232-1, which may be the same as the firmware 132 included in base station antenna 100, may be loaded into the RET controller 130. In this configuration, base station antenna 200 may be identical to base station antenna 100 and will operate in the exact same manner to independently control the electrical down tilt of vertical arrays 110-1, 110-2 in response to external control signals. In the second configuration, firmware 232-2 is loaded into the RET controller 130. Firmware 232-2 is configured so that upon receipt of an external control signal calling for commonly adjusting the electrical down tilt settings on both vertical arrays 110-1, 110-2, the RET controller 130 transmits a first internal control signal M1 to RET actuator 140-1 to implement the change in the electrical down tilt on the first vertical array 110-1. Once that adjustment to the electrical down tilt is completed, the RET controller 130 transmits a second internal control signal M2 to RET actuator 140-2 to implement the change in the electrical down tilt on the second vertical array 110-2. In other embodiments, the control signals M1, M2 may be transmitted to both RET actuators 140-1, 140-2 simultaneously.

Figure 3:
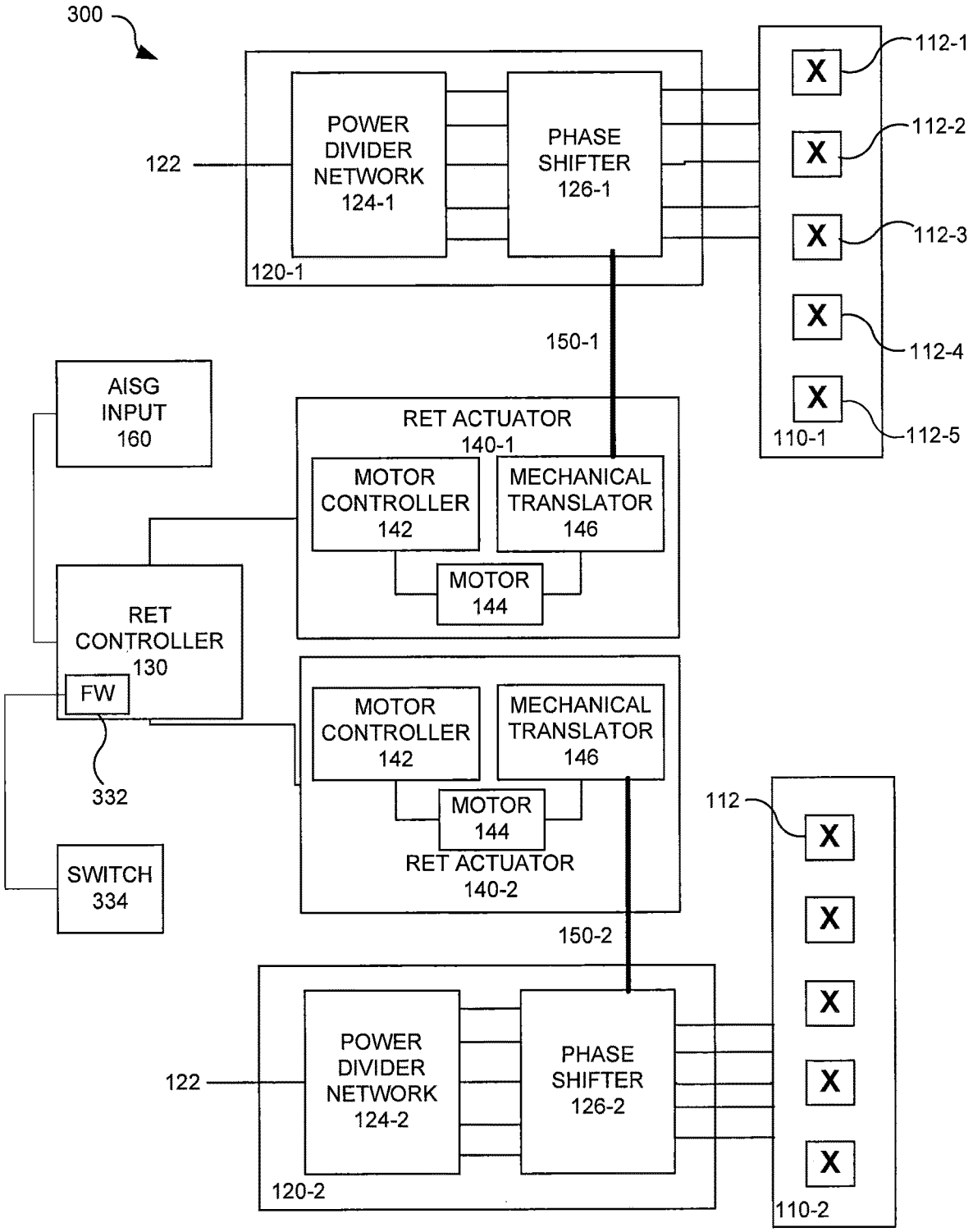
FIG. 3 is a schematic diagram of a base station antenna according to further embodiments of the present invention that may provide independent or common control of the down tilt applied to the vertical arrays of the antenna.

FIG. 3 is a schematic diagram of a base station antenna 300 according to further embodiments of the present invention. The base station antenna 300 is very similar to the base station antenna 200, except that the base station antenna 300 includes a selection mechanism 334 such as, for example, a switch, that may be used to set the antenna 300 to either independently control the down tilt on the vertical arrays 110-1, 110-2 or, alternatively, to commonly control the down tilt on the vertical arrays 110-1, 110-2. The base station antenna 300 may include firmware 332 that implements the independent or common control of the down tilts on the first and second vertical arrays 110-1, 110-2 based on a setting of the selection mechanism 334.

As made clear from the above description, the base station antennas according to embodiments of the present invention may independently control the down tilt on multiple vertical arrays 110 or commonly control the down tilt on those vertical arrays 110 based on, for example, the firmware 232 loaded into the RET controller 130 of the antenna. Since the base station antenna supports independent control of the down tilt, the antenna necessarily includes the full number of RET actuators required for independent control. When the base station antennas according to embodiments of the present invention are operated to have commonly controlled down tilt, the firmware may be programmed to, for example, sequentially activate the RET actuators to apply a phase shift specified by an external control signal so that the specified phase shift is applied to each vertical array 110 in turn.

When the base station antennas according to embodiments of the present invention are operated so that the down tilt on at least two vertical arrays is commonly controlled, the common control of the down tilt may be implemented in different ways. In some embodiments the RET controller 130 may control the RET actuators 140 so that the common phase shift is applied to both vertical arrays 110-1, 110-2 at the same time In other embodiments, the RET controller 130 may control the RET actuators 140 so that they are moved sequentially in response to the control signal. This sequential approach may help ensure that the maximum AISG power requirements are not violated. When the sequential approach is used, for a small period of time, the electrical down tilt will be applied to one but not all of the vertical arrays 110. This, however, should have a negligible impact on network performance.

Figure 4:
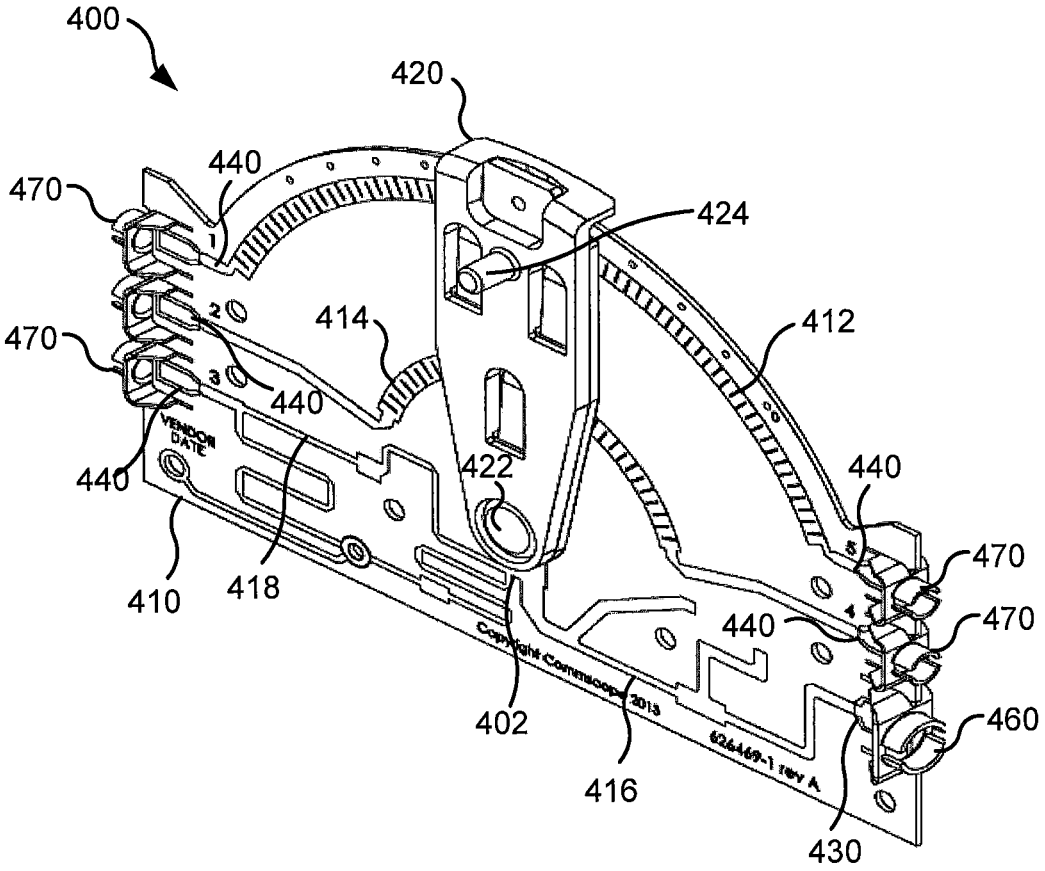
FIG. 4 is a perspective view of an electromechanical rotary wiper arc phase shifter that may be used in the base station antennas according to embodiments of the present invention.
Figure 5:
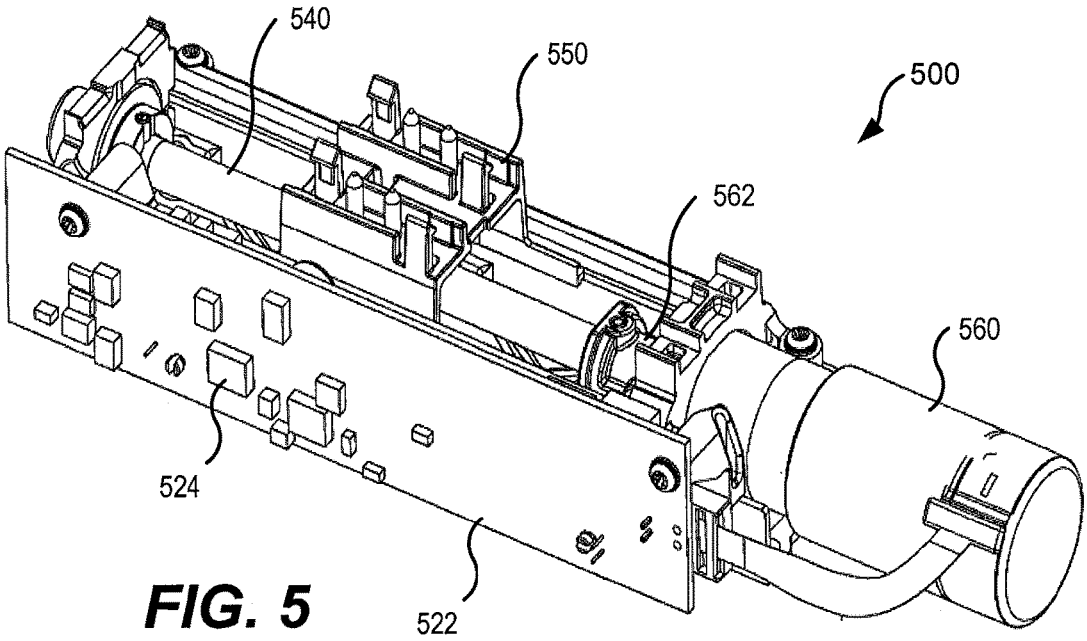
FIG. 5 is a perspective view of a RET actuator that may be used in the base station antennas according to embodiments of the present invention.
Figure 6:
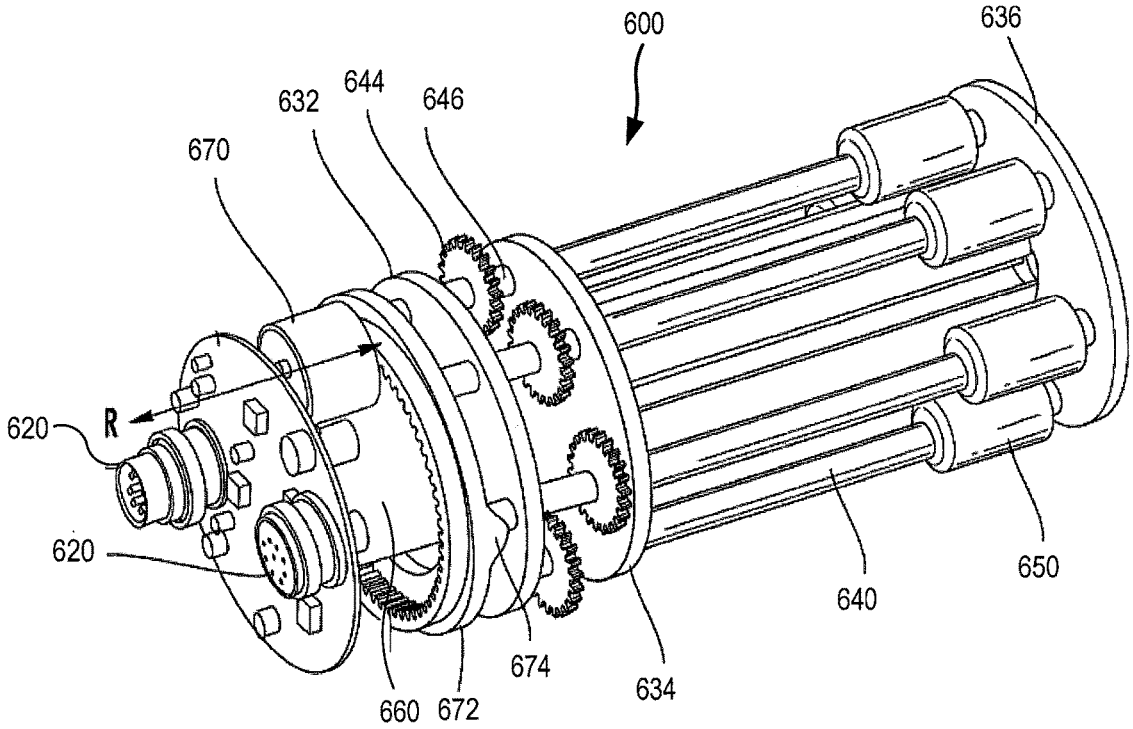
FIG. 6 is a perspective view of a multi-RET actuator assembly that may be used in the base station antennas according to embodiments of the present invention.

As discussed above, the base station antennas according to embodiments of the present invention may include, among other things, power divider networks 124, phase shifters 126 and RET actuators 140. FIGS. 4-6 illustrate example implementations of each of these components that may be used in certain embodiments of the present invention.

Turning first to FIG. 4 an electromechanical rotary wiper arc phase shifter 400 is illustrated that may be used to implement the power divider networks 124 and phase shifters 126 that are included in embodiments of the present invention.

As shown in FIG. 4, the phase shifter 400 includes a main (stationary) printed circuit board 410 and a rotatable wiper printed circuit board 420 that is rotatably mounted on the main printed circuit board 410 via a pivot pin 422. The position of the rotatable wiper printed circuit board 420 above the main printed circuit board 410 is controlled by the position of a mechanical linkage (not shown) that may connect, for example, to post 424 on the wiper printed circuit board 420. The other end of the mechanical linkage (not shown) may be coupled to a RET actuator 140.

The main printed circuit board 410 includes a plurality of generally arcuate transmission line traces 412, 414. In some cases the arcuate transmission line traces 412, 414 may be disposed in a serpentine pattern to achieve a longer effective length. In the example illustrated in FIG. 4, there are two arcuate transmission line traces 412, 414, with the first arcuate transmission line trace 412 being disposed along an outer circumference of printed circuit board 410 and the second arcuate transmission line trace 414 is disposed on a shorter radius concentrically within the outer transmission line trace 412. A third transmission line trace 416 on main printed circuit board 410 connects an input pad 430 on the printed circuit board 410 to a power divider 402. A first output of the power divider 402, which carries the majority of the power of any RF signal input at input pad 430, capacitively couples to a circuit trace (not visible) on the wiper printed circuit board 420. The second output of the power divider 402 connects to an output pad 440 via a transmission line trace 418. RF signals that are coupled to this output pad 440 are not subjected to an adjustable phase shift.

The wiper printed circuit board 420 includes another power divider (not shown since on the rear side of wiper printed circuit board 420) that divides the RF signals coupled thereto. One output of this power divider couples to a first pad (not shown) on wiper printed circuit board 420 that overlies transmission line trace 412, and the other output of this power divider couples to a second pad (not shown) on wiper printed circuit board 420 that overlies transmission line trace 414. The first and second pads capacitively couple the respective outputs of the power divider on wiper printed circuit board 420 to the respective transmission line traces 412, 414 on the main printed circuit board 410. Each end of each transmission line trace 412, 414 may be coupled to a respective output pad 440. A cable holder 460 may be provided adjacent the input pad 430 to facilitate connecting a coaxial cable or other RF transmission line component to the input pad 430. Respective cable holders 470 may be provided adjacent each of the output pads 440 to facilitate connecting additional coaxial cables or other RF transmission line component to each output pad 440. As the wiper printed circuit board 420 moves, an electrical path length from the input pad 430 of phase shifter 400 to each radiating element 112 changes. For example, as the wiper printed circuit board 420 moves to the left it shortens the electrical length of the path from the input pad 430 to the output pad 440 connected to the left side of transmission line trace 412, while the electrical length from the input pad 430 to the output pad 440 connected to the right side of transmission line trace 412 increases by a corresponding amount. These changes in path lengths result in phase shifts to the signals received at the output pads 440 connected to transmission line trace 412 relative to, for example, the output pad 440 connected to transmission line trace 418. Thus, the phase shifter 400 may receive an RF signal at input pad 430, divide the RF signal into a plurality of sub-components, apply different amounts of phase shift to each sub-component, and output the phase-shifted sub-components on output pads 440.

FIG. 5 illustrates a RET actuator 500 that may be used to implement the RET actuators 140 that are included in embodiments of the present invention. As shown in FIG. 5, the RET actuator 500 includes a printed circuit board 522, a worm gear shaft 540, a piston 550 and a motor 560. A drive shaft 562 of the motor 560 is axially aligned with the worm gear shaft 540, and the worm gear shaft 540 is attached to the drive shaft 562 so that rotation of the drive shaft 562 results in rotation of the worm gear shaft 540. While not shown in FIG. 5, the worm gear shaft 540 is externally threaded. The piston 550 is internally threaded and is mounted on the worm gear shaft 540. A mechanical linkage (not shown) such as mechanical linkage 150 is attached to the piston 550. The mechanical linkage may comprise, for example, a rod, shaft or the like that connects at one end to the piston 550 and connects at the other end to, for example, the wiper printed circuit board 420 of a rotary wiper arc phase shifter 400.

The mechanical linkage (not shown) that is attached to the piston 550 prevents the piston 550 from rotating in response to rotation of the worm gear shaft 540. The piston 550 is internally threaded to mate with the external threads on the worm gear shaft 540. When the worm gear shaft 540 rotates, the piston 550 will move axially relative to the worm gear shaft 540. Consequently, rotation of the worm gear shaft 540 results in axial movement of the piston 550 mounted thereon, and this axial movement is transferred via the mechanical linkage to a phase shifter in order to rotate a wiper arm of the phase shifter. The RET actuator 500 further includes a printed circuit board that may include a processor 524 mounted thereon. Internal control signals may be transmitted from the RET controller 130 to the processor 524 via, for example, a cabling connection (not shown). In response to such control signals, the processor 524 may control the motor 560 to rotate in a desired direction for a number of rotations that is sufficient to adjust a down tilt of one or more of the vertical arrays 110.

FIG. 6 is a front perspective view of a multi-RET actuator assembly 600 that may be used in base station antennas according to some embodiments of the present invention. A multi-RET actuator assembly refers to a RET actuator assembly that includes two or more RET actuators. The multi-RET actuator assembly 600 includes a plurality of RET actuators. Each RET actuator has a mechanical translator in the form of a worm gear shaft 640 with a piston 650 mounted thereon that may be used to move a mechanical linkage 150. The multi-RET actuator assembly 600 is capable of independently adjusting up to six phase shifters. Additional examples of multi-RET actuator assemblies are disclosed in U.S. Provisional Application Ser. No. 62/420,773, filed Nov. 11, 2016, the entire content of which is incorporated herein by reference.

The multi-RET actuator assembly 600 includes a housing (not shown). Connectors 620 may be provided that connect to one or more communications cables that may be used to deliver control signals from a RET controller to the multi-RET actuator assembly 600. The multi-RET actuator assembly 600 includes circular base plates 632, 634, 636. Six externally threaded worm gear shafts 640 extend along respective parallel longitudinal axes between base plates 632 and 636. Each worm gear shaft 640 is rotatably mounted in the base plates 632, 634, 636. Respective secondary drive gears 644 are mounted on the worm gear shafts 640.

A spring 646 is mounted on each worm gear shaft between the base plate 634 and the respective secondary drive gears 644. Each secondary drive gear 644 may move axially between the base plates 632, 634, and will rotate in concert with its associated worm gear shaft 640. The springs 646 bias the secondary drive gears 644 toward base plate 632. The spring loading of the secondary drive gears 644 may assist in returning the secondary drive gears 644 to their disengaged positions.

A piston 650 is mounted on each worm gear shaft 640. Each piston 650 may be connected to one end of a respective mechanical linkage (not shown). The mechanical linkage may prevent each piston 650 from rotating in response to rotation of its respective worm gear shaft 640. Each piston 650 may be internally threaded to mate with the external threads on its corresponding worm gear shaft 640. Each piston 650 may thus be configured to move axially relative to its associated worm gear shaft 640 upon rotation of the worm gear shaft 640. The far end of each mechanical linkage may be connected to a wiper arm of a phase shifter. Consequently, rotation of a worm gear shaft 640 may result in axial movement of the piston 650 mounted thereon, and this axial movement is transferred via the mechanical linkage to a phase shifter in order to rotate a wiper arm of the phase shifter.

The multi-RET actuator 600 further includes a drive motor 660 and an indexing motor 670. The drive motor 660 turns a drive shaft to rotate about an axis that is parallel to the axes defined by the worm gear shafts 640. A primary drive gear (not visible in FIG. 6, but located in the center of the circle defined by the secondary drive gears 644 and offset axially from the secondary drive gears towards the base plate 634) is mounted on the drive shaft. The indexing motor 670 may be used to rotate an indexing plate 672. The indexing plate 672 includes a cam 674. As the cam 674 rotates, it sequentially engages an end of each worm gear shaft 640, which forces the worm gear shaft 640 and the secondary drive gear 644 attached thereto axially into an "engaged" position where the secondary drive gear 644 mates with the primary drive gear. When the primary drive gear rotates, it rotates the engaged secondary drive gear 644, which in turn rotates the associated worm gear shafts 640, thereby resulting in axial movement of one of the pistons 650. The primary drive gear 664 may be rotated in a first direction (e.g., clockwise) to move the piston 650 on the worm gear shaft 640 with the engaged secondary drive gear 644 away from the drive motor 660, and may be rotated in a second direction (e.g., counter-clockwise) to move the piston 650 on the worm gear shaft 640 with the engaged secondary drive gear 644 toward the drive motor 660.

Upon receiving a signal from a controller that a phase shift in the antenna is desired, the indexing motor 670 may be activated to move the indexing plate 672 so that the cam 674 engages a selected one of the worm gear shafts 640. As the cam 674 engages the worm gear shaft 640, the secondary drive gear 644 that is mounted on the worm gear 640 engages the primary drive gear 664. Then, the drive motor 660 is activated to rotate the primary drive gear 664. Rotation of the primary drive gear 664 rotates the engaged secondary drive gear 644, which in turn rotates the worm gear shaft 640 that is mounted on the engaged secondary drive gear 644. Rotation of the worm gear shaft 640 drives the piston 650 axially along its associated worm gear shaft 640 until the piston 650 reaches a desired position, at which point the motor 660 deactivates.

Providing a single base station antenna design that may be configured to have either independently controlled or commonly controlled down tilts may provide a number of advantages. These advantage include decreased design and development time, a reduction in the total number of parts required, and the need for only a single set of build instructions. Additionally, it is not uncommon that fluctuation in sales demand make it necessary to reconfigure a base station antenna that provides independent control of the down tilt to instead exhibit common control, or vice versa. This may be expensive and time-consuming to do when the antennas are configured in the fashion discussed above with reference to FIGS. 1A and 1B. With the antennas according to embodiments of the present invention, the reconfiguration may be as simple as changing a switch setting, re-uploading a different firmware package, reconfiguration by an AISG vendor message and/or by a tunneled AISG message or sending the reconfiguration, data as a simulated firmware update.

Additional RET actuators and mechanical linkages may be included in the antennas according to embodiments of the present invention as compared to conventional antennas that having common down tilt control. However, the expense associated with the extra parts tends to be insignificant compared to the increased design and development costs associated with providing two different antenna designs. Moreover, a typical multi-RET actuator assembly may cost approximately the same amount as two single RET actuators. Accordingly, whenever two or more RET actuators are necessary it may be cost-effective to use a multi-RET actuator assembly instead of multiple single RET actuators. As a result, in most cases where multi-RET actuator assemblies are used in the base station antenna, the provision of the additional, unused RET actuators in the antenna will result in no additional cost, as it would have been cheaper to use a multi-RET actuator assembly with unused actuators rather than a smaller number of single RET actuators.

Figure 7:
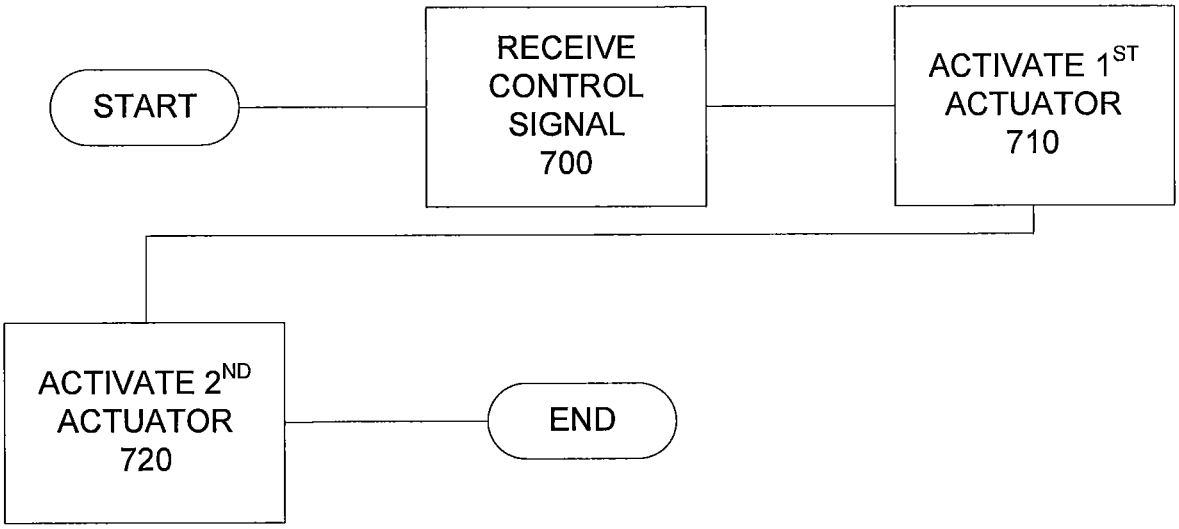
FIG. 7 is a flow chart illustrating a method of operating a base station antenna according to certain embodiments of the present invention.

Pursuant to further embodiments of the present invention, methods of operating a base station antenna are provided. As shown in FIG. 7, pursuant to these methods, a first control signal may be received at a base station antenna (Block 700). The control signal may comprise, for example, an AISG control signal which may be provided to a RET controller of the base station antenna. In response to the received control signal, a first RET actuator may be activated to move a first mechanical linkage in the antenna (Block 710). This may be accomplished, for example, by the RET controller transmitting an internal control signal to the first RET actuator. Also in response to the external control signal, a second RET actuator may be activated to move a second mechanical linkage in the antenna (Block 720). This may be accomplished, for example, by the RET controller transmitting an internal control signal to the second RET actuator. The movements of the first and second mechanical linkages may adjust the settings on first and second phase shifters of the base station antenna in order to adjust the electrical down tilt on respective first and second vertical arrays of the base station antenna.

In some embodiments, the first and second RET actuators may activated at the same time in response to the external control signal. In other embodiments, the first and second RET actuators may be activated at different times. In such embodiments, the second RET actuator may be activated immediately after the first RET actuator. The first RET actuator may be moved the same amount as the second RET actuator so that the same adjustment in phase shift is made to each of the first and second vertical arrays.

It will be appreciated that many changes may be made to the above-described embodiments. For example, while the above embodiments are primarily described with respect to adjusting the down tilt on an antenna, it will be appreciated that in some cases the antennas may have an up tilt that is varied (i.e., an elevation angle greater than zero degrees). It will similarly be appreciated that azimuth pointing angles for the radiation patterns may likewise be independently or commonly adjusted in the same manner. As another example, while embodiments are described above in which firmware is used to configure an antenna for independent or common control of the down tilt for two or more vertical arrays, in other embodiments, this may be accomplished in software and/or hardware or any other appropriate means. As another example, while in the above embodiments each output port of the phase shifters 126 are coupled to a respective radiating element 112, in other embodiments some or all of the outputs of the phase shifters 126 may be coupled to sub-arrays that include two or more radiating elements. This may allow for simpler phase shifter designs at the expense of reduced granularity in the phase taper applied to the radiating elements 112. As yet another example, the worm gear shafts and pistons described above may be replaced with other suitable mechanical translators in other embodiments. In some embodiments, the mechanical translators may be omitted (e.g., rotative motion may be used to adjust the phase shifters).

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the terms "attached", "connected", "interconnected", "contacting", "mounted" and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

That which is claimed is:

1. A method of operating a base station antenna, the method comprising: receiving a first control signal at the base station antenna; activating a first actuator to move a first mechanical linkage in response to the first control signal; activating a second actuator to move a second mechanical linkage in response to the first control signal, wherein the first actuator drives the first mechanical linkage to adjust a first phase shifter in order to apply an electrical down tilt of a first number of degrees to a first array of radiating elements of the base station antenna, and the second actuator drives the second mechanical linkage to adjust a second phase shifter in order to apply an electrical down tilt of the first number of degrees to a second array of radiating elements of the base station antenna.

2. The method of claim 1, wherein the first and second actuators are activated at different times.

3. The method of claim 2, wherein the second actuator is activated immediately after the first actuator.

4. The method of claim 3, wherein the first actuator is moved the same amount as the second actuator.

5. The method of claim 1, wherein the first actuator is moved the same amount as the second actuator.

6. The method of claim 5, wherein the first actuator drives the first mechanical linkage to adjust a first phase shifter in order to apply an electrical down tilt of a first number of degrees to a first array of radiating elements of the base station antenna, and the second actuator drives the second mechanical linkage to adjust a second phase shifter in order to apply an electrical down tilt of the first number of degrees to a second array of radiating elements of the base station antenna.

7. The method of claim 6, wherein the base station antenna includes a remote electrical down tilt (RET) controller that includes firmware that is configured to receive the first control signal and in response thereto generate sequential first and second internal control signals that are used to activate the respective first and second actuators.

8. The method of claim 7, wherein the first actuator and the second actuator are part of a multi-RET actuator assembly that includes a plurality of RET actuators.

9. The method of claim 8, wherein the base station antenna includes a selection mechanism that selectively configures the base station antenna to either independently control or commonly control down tilts on first and second arrays of radiating elements.

10. The method of claim 9, wherein the base station antenna includes first and second arrays of radiating elements that are configured for multi-input-multi-output transmission, wherein the first array of radiating elements is fed by a first phase shifter that is attached to the first mechanical linkage, and the second array of radiating elements is fed by a second phase shifter that is attached to the second mechanical linkage.

11. The method of claim 1, wherein the base station antenna includes a remote electrical down tilt (RET) controller that includes firmware that is configured to receive the first control signal and in response thereto generate sequential first and second internal control signals that are used to activate the respective first and second actuators.

12. The method of claim 11, wherein the first actuator and the second actuator are part of a multi-RET actuator assembly that includes a plurality of RET actuators.

13. The method of claim 1, wherein the first control signal comprises an AISG control signal.

14. The method of claim 1, wherein the base station antenna includes a selection mechanism that selectively configures the base station antenna to either independently control or commonly control down tilts on first and second arrays of radiating elements.

15. The method of claim 1, wherein the base station antenna includes first and second arrays of radiating elements that are configured for multi-input-multi-output transmission, wherein the first array of radiating elements is fed by a first phase shifter that is attached to the first mechanical linkage, and the second array of radiating elements is fed by a second phase shifter that is attached to the second mechanical linkage.

16. A method of operating a base station antenna, the method comprising: receiving a first control signal at the base station antenna; activating a first actuator to move a first mechanical linkage a first amount in response to the first control signal; and then activating a second actuator to move a second mechanical linkage the first amount in response to the first control signal, wherein the first and second actuators are both moved the first amount based on a selection mechanism in the antenna being set to specify common control of the down tilt on arrays of radiating elements associated with the first and second actuators.

17. The method of claim 16, wherein the base station antenna includes a controller that is configured to control the first actuator to move in response to the first control signal to move the first mechanical linkage the first amount and after the movement of the first actuator is completed to then control the second actuator to move the second mechanical linkage the first amount.

18. The method of claim 16, wherein the first and second actuators are both moved the first amount based on firmware in the antenna that is programmed for common control of the down tilt on arrays of radiating elements associated with the first and second actuators.

* * * * *